United States Patent [19]

Davis

[11] 3,960,131

[45] June 1, 1976

[54] INTERNAL COMBUSTION ENGINE STARTING SYSTEM

[75] Inventor: Bill G. Davis, Phoenix, Ariz.

[73] Assignee: Jetco, Inc., Phoenix, Ariz.

[22] Filed: Nov. 29, 1974

[21] Appl. No.: 528,561

[52] U.S. Cl. ..... 123/187.5 R; 123/180 R

[51] Int. Cl.[2] ..... F02M 1/16

[58] Field of Search ..... 123/180 R, 180 A, 180 AC, 123/180 T, 187.5 R

[56] References Cited

UNITED STATES PATENTS

| | | | |
|---|---|---|---|
| 3,189,014 | 6/1965 | Kus | 123/187.5 R |
| 3,198,404 | 8/1965 | Welches | 222/402.25 |
| 3,297,011 | 1/1967 | Gray | 123/180 R |
| 3,338,227 | 8/1967 | Engstrom | 123/180 R |
| 3,416,507 | 12/1968 | Little | 123/180 R |
| 3,448,733 | 6/1969 | Ashe | 123/180 R |
| 3,704,702 | 12/1972 | Aono | 123/187.5 R |
| 3,827,417 | 8/1974 | Mority | 123/180 R |

*Primary Examiner*—Wendell E. Burns
*Assistant Examiner*—David D. Reynolds
*Attorney, Agent, or Firm*—Cahill, Sutton & Thomas

[57] ABSTRACT

A starting system for use with an internal combustion engine is shown utilizing a container of compressed volatile fluid to be injected into the engine upon starting. The fluid is delivered from the container through the actuation of a solenoid that subsequently provides a metered quantity of the fluid to the engine. The solenoid is connected in electrical series with the engine starting switch, a timing switch, and a thermostatic switch. Operation of the starting switch results in the opening and closing of the timer switch to alternately break and complete the series circuit; the thermostatic switch is normally closed and is opened to break the series circuit when the engine temperature reaches a predetermined value.

1 Claim, 1 Drawing Figure

INTERNAL COMBUSTION ENGINE STARTING SYSTEM

Figure 1:
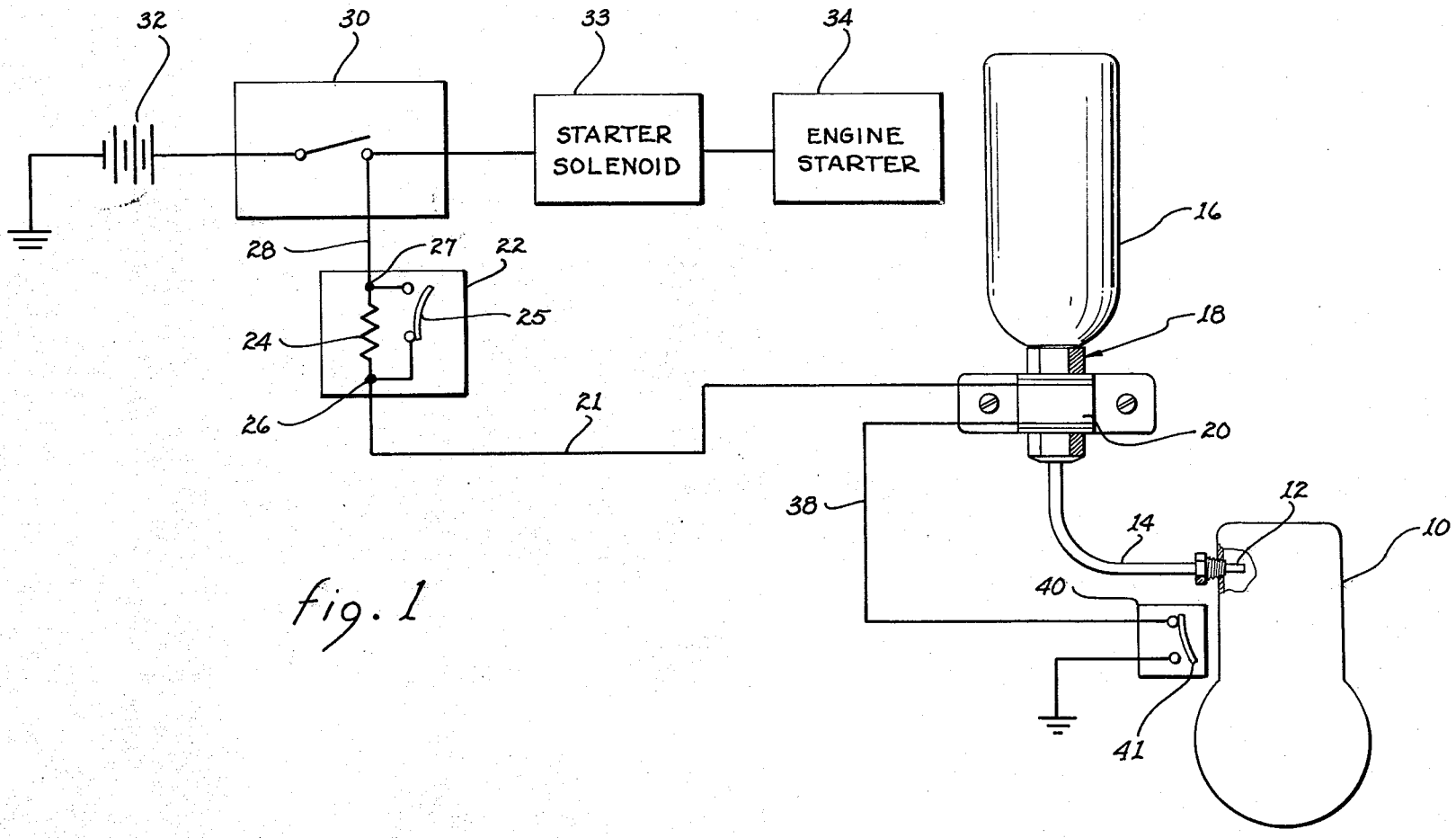

The present invention relates to engine starting systems, and more particularly to such systems utilizing the injection of a highly volatile fluid such as ether, into the engine to facilitate starting.

Starting of internal combustion engines, particularly large diesel engines of the type used in trucks and the like, are frequently difficult to start. To assist such starting, it has been the practice to supply a highly volatile fluid, such as ether, to the engine intake during the initial "cranking" of the engine. The facility with which such engines can be started using this technique usually varies according to specific engine design, the condition of the engine, as well as the environmental factors, such as temperature. Frequently, the engine will fail to start at the initial attempt and the starting procedure must be repeated.

The quantity of ether, or similar fluid, delivered to the engine can be an important parameter, and systems have been developed for delivering a metered quantity of such fluid to the engine upon each actuation of the solenoid controlling the flow of fluid. However, under adverse conditions, engine starting can still be difficult and require repeated attempts to complete the starting procedure.

It is important that the proper metered quantity of fluid be administered to the engine for these repeated attempts to thereby maximize the probability of engine starting. Frequently, immediately upon starting, the engine will falter and subsequently stall as soon as the effects of the injected ether are diminished.

It is therefore an object of the present invention to provide an engine starting system utilizing a volatile starting fluid which will provide the proper continuous metered quantity of the fluid during the starting procedure.

It is another object of the present invention to provide an engine starting system utilizing a volatile starting fluid wherein quantities of fluid are repeatedly injected at timed intervals, into the engine during the starting procedure.

It is still another object of the present invention to provide an engine starting system utilizing a volatile starting fluid wherein the fluid continues to be applied to the engine immediately after it has started to prevent faltering.

These and other advantages will become apparent to those skilled in the art as the description thereof proceeds.

Briefly, in accordance with the embodiment chosen for illustration, a bottle of compressed ether or similar volatile starting fluid is provided with a solenoid actuated metering system for delivering a measured quantity of the fluid upon each energization of the solenoid. The solenoid is connected in electrical series with a timing switch which, in turn, is connected to the engine starter switch. The timer switch is normally open and is of the type that will close in approximately one second after voltage has been applied thereto and will thereafter open and close at intervals of approximately one second. Upon closing, the appropriate voltage is applied to the solenoid to supply a metered quantity of ether to the engine.

The present invention may more readily be described by reference to the accompanying drawing in which is shown a schematic representation of an engine starting system constructed in accordance with the teachings of the present invention.

Referring to the drawing, an engine 10 is schematically shown having an injector nozzle 12 threadedly secured therein for receiving measured quantities of a volatile starting fluid such as ether. A conduit 14 is connected to a container 16 of compressed fluid through a metering system shown generally at 18; the metering system 18 is actuated by the energization of a solenoid 20. A suitable metering system is shown and described in U.S. Letters Pat. No. 3,198,404 - Welches. In that patent, a pressurized dispenser is connected to a metering arrangement that is actuated by energization of a solenoid; by providing suitable current to the solenoid, a quantity of the volatile fluid is measured. Upon de-energization of the solenoid the measured quantity of fluid is injected through the intake manifold of the engine.

Referring again to the drawing, the solenoid 20 is connected through conductor 21 to a timing switch 22. The switch 22 includes a heating resistor 24 and a bimetal-type switch arm 25. The timing switch 22 is normally open and is closed only after the heating resistor 24 causes the bimetal 25 to snap to the closed position. A variety of presently existing timing switches may be utilized in the system of the drawing; for example, it has been found that for use in a 12-volt system, standard heavy duty two-terminal 12 volt flasher units provide acceptable performance.

As mentioned previously, the conductor 21 is connected to terminal 26 of the switch 22; terminal 27 is connected through conductor 28 to a starter switch 30. The starter switch may be a typical key-operated ignition switch with the combined function of an ignition and starter switch or may be an independent type starter switch. In either case, actuation of the switch 30 connects the storage battery 32 to the starter solenoid 33 which, in turn, appropriately applies voltage to an engine starter motor 34 in a well known manner which need not be described here. In some instances, the starter switch 30 may be utilized to electrically actuate a valving means to operate a pneumatical starting system. In still other instances, manual valving is used for air starting, and in such cases an air pressure switch is used to replace the starter switch in the system of the present invention. Whether the switch 30 is used to actuate an electrical starter or a pneumatical starter, or whether the switch 30 is actuated by air pressure, the closing of the switch 30 nevertheless connects the voltage from the battery 32 to the timer switch 22.

The other side of the solenoid 20 is connected through conductor 38 to a thermostatic switch 40 which is strategically mounted to detect engine temperature. The switch 40 includes a bimetal switch arm 41 which, while normally closed, will open when a predetermined temperature is reached. A suitable thermostatic switch for use in the system of the present invention may be purchased from Therm-O-Disc, Inc. (type 20T21). The switch 40 may be mounted in contact with the engine water jacket and is preferably mounted at a position known to be the hottest location. Thus, it may be seen that the battery 32, switch 30, switch 22, solenoid 20 and switch 40 are connected in an electrical series.

In operation, assuming the engine is cold, the switch 22 will be in its normally open position and the switch 40 will be in its normally closed position. When the starter switch 30 is closed, an electric circuit is completed through the resistor 24 (it may be noted that the resistance of the resistor 24 prevents sufficient current from flowing through the conductor 21 to cause energization of the solenoid 21). Using a typical 12-volt flasher as above described, the bimetal switch arm 25 will close in less than one second and effectively complete a low resistance path between terminals 26 and 27. The resistor 24 will thereafter begin to cool and the bimetal 25 will subsequently open; the opening and closing of the low resistance path between terminals 26 and 27 will continue at intervals of approximately one second. Each time the bimetal contact 25 closes, the solenoid 20 becomes energized and a quantity of starting fluid is measured in the metering system 18. Each time the bimetal 25 opens, the solenoid 20 becomes de-energized and the previously metered quantity of fluid is administered through conduit 14 to the engine 10. When the engine starts, and the switch 30 is opened, the solenoid 20 is automatically de-energized and provides additional metered fluid during the period immediately following engine starting.

It would normally be harmful to admit the highly volatile starting fluid to the engine when the engine is warm, therefore, the normally closed thermostatic switch 40 opens when the engine reaches a predetermined temperature, thus preventing the injection of the volatile fluid into the engine and preventing possible serious damage thereto.

The present invention has been described in terms of a specific type of timing switch 22, although it will be obvious to those skilled in the art that other types of timing switches may be utilized to accommodate other types of metering and dispensing apparatus.

I claim:

1. In an electrically actuated series connected starting system for a water jacket encased internal combustion engine having a starter switch connected to a battery, the improvement comprising in combination:

a. a container for storing a volatile starting fluid under pressure;

b. an electrically actuatable discharge means connected to said container for discharging the starting fluid from said container, said discharge means including an electrically actuated solenoid means for metering a predetermined quantity of the fluid upon electrical energization of said discharge means and for discharging the predetermined quantity of the starting fluid upon electrical de-energization of said discharge means;

c. conduit means extending from said discharge means to the engine for transmitting the discharged predetermined quantity of the starting fluid from said discharge means to the engine;

d. a timing switch electrically connected in series between the starter switch and said discharge means for periodically electrically energizing said discharge means, said timing switch including a current limiting heating element connected in parallel with a normally open bimetallic relay responsive to said heating element for periodically establishing a short circuit across said heating element;

e. a normally closed thermostatic switch mounted adjacent the water jacket of the engine for sensing the ambient temperature of the engine, said thermostatic switch being actuated in response to a predetermined ambient temperature of the engine;

f. electrical conductor means for electrically connecting said thermostatic switch to said discharge means; and g. further electrical conductor means for electrically connecting said thermostatic switch to the battery; whereby, the starting fluid is continually periodically discharged into the engine until either the starting switch is turned off or until the engine reaches an ambient temperature, whichever occurs first.

* * * * *